United States Patent [19]

Salete-Garces

[11] Patent Number: 5,048,407

[45] Date of Patent: Sep. 17, 1991

[54] GRAIN HUSKING AND POLISHING MACHINE

[76] Inventor: Felipe Salete-Garces, Av. Año de Juarez No. 198 Col., Granjas San Antonio 09070 D.F., Mexico

[21] Appl. No.: 606,973

[22] Filed: Oct. 31, 1990

[30] Foreign Application Priority Data

Nov. 7, 1989 [MX] Mexico ..... 18264
Oct. 19, 1990 [MX] Mexico ..... 22939

[51] Int. Cl.[5] ..... B02B 3/00; B02B 3/04; B02B 3/06

[52] U.S. Cl. ..... 99/519; 99/523; 99/528; 99/603; 99/607; 99/608; 99/611; 99/617

[58] Field of Search ..... 99/518, 519, 523, 525-528, 99/602-607, 610-615, 617, 608, 618, 622, 628; 426/481-483

[56] References Cited

U.S. PATENT DOCUMENTS

| | | | |
|---|---|---|---|
| 3,857,333 | 12/1974 | Satake | 99/601 |
| 3,952,454 | 4/1976 | Satake | 99/525 |
| 3,960,068 | 6/1976 | Salete | 99/606 |
| 4,292,890 | 10/1981 | Garces | 99/617 |
| 4,329,371 | 5/1982 | Hart | 99/520 |
| 4,459,903 | 7/1984 | Yamamoto | 99/519 |
| 4,572,063 | 2/1986 | Yamamoto | 99/618 |
| 4,577,552 | 3/1986 | Yamamoto | 99/528 |
| 4,583,455 | 4/1986 | Garces | 99/519 |
| 4,829,893 | 5/1989 | Satake | 99/611 |
| 4,843,957 | 7/1989 | Satake | 99/617 |

*Primary Examiner*—Timothy F. Simone
*Attorney, Agent, or Firm*—Sughrue, Mion, Zinn, Macpeak and Seas

[57] ABSTRACT

The versatility of a grain husking and polishing machine to treat grains of different types is improved by providing a grain treatment chamber constituted by an abrasive rotor mounted on a fixed axis and a screen assembly surrounding said rotor and mounted on a movable annular plate actuated by a sidewardly movable mechanism capable of changing the eccentrically of said screen assembly with respect to said rotor. A more efficient combined husking and polishing action is accomplished by providing a rotor comprising a plurality of cam-like abrasive discs spaced apart by a corresponding plurality of spacer rings having a diameter smaller than that of the discs so as to form grain expansion chambers therebetween, whereby an energetic husking action followed by a moderate abrading polishing action are effected along the treatment chamber.

17 Claims, 6 Drawing Sheets

GRAIN HUSKING AND POLISHING MACHINE

FIELD OF THE INVENTION

The present invention refers to the husking and polishing of grains and, more particularly, it is related to a machine for husking and polishing grains or cereals with a minimum breakage of said grains and with sufficient versatility to vary the husking and polishing action without stopping the machine.

BACKGROUND OF THE INVENTION

Air-swept machines for husking or polishing cereal grains are very well known in the art and many different types of said machines are available in the market.

For many years, however, the husking and the polishing operations were carried out in grain mills through the use of different stages, each requiring the use of different machines, due to the fact that the husking of grain was believed to require different rubbing elements as compared to the polishing of cereal grains. This obviously required the provision of intermediate stages for the removal of the husk produced by the husking machines, before the husked grain could be fed to the polishing machines.

In more recent times, a new family of air-swept machines designed to serve both as grain husking and as grain polishing machines was introduced. This type of machines, however, started to be designed as machines having an air-swept treatment chamber formed by a cylindrical abrasive rotor and a polygonal indented screen surrounding said rotor, because it was believed that the use of such polygonal indented screens would increase the efficiency of the apparatus, due to the obstructions produced by the corners thereof on the moving grains, which allegedly would force the grains to be rubbed against each other in said corner areas, accomplishing a more energetic action thereon. The experience gained through the use of said machines throughout the years, however, has proven that said corner areas, rather than effecting the alleged more energetic action on the grains, were areas of heavy accumulation of grains, wherein the grains therefore were not rubbed at all and remained in their original condition throughout the period of treatment.

In order to overcome the above described drawbacks shown by these prior art machines, a new generation of air-swept grain husking and polishing machines was created which, by the use of specially designed screen members, were capable of avoiding the formation of accumulations of untreated grains within the treatment chamber.

One of this new type of machines was described and claimed in U.S. Pat. No. 3,960,068 to Felipe Salete, the same applicant hereof, who describes an air-swept rice polishing machine comprising a treatment chamber for grain which was constituted by a hollow rotor and a cylindrical indented screen surrounding the same. The rotor is preceded by a screw conveyor for forcedly conveying the grain stream upwardly towards said rotor and said rotor has a pair of rectractible knives to retain the movement of the grain at will, whereby the pressure applied by said screw conveyor pushes the grain to be trapped by said rotor, which spins the mass of grains against the action of the indented screen, thus rubbing the grains effectively without accumulation thereof. This machine, however, due to its rotor design, is not capable of husking the grain, whereby an additional husking stage must be incorporated.

One other husking and polishing machine for grains is described and claimed in U.S. Pat. No. 4,292,890 to Salete, which solves the above described problems of the prior art machines, by incorporating a new design of screen and rotor assembly which comprises a cylindrical rotor having two specially designed fluted knives tangentially arranged thereto, such that the grains are gradually pressed when trapped by each knife which is inclined outwardly of the periphery of the rotor, contrary to the direction of movement of the same, and a screen supported by a specially designed screen holder, which comprises two semi-cylindrical screen members attached and fastened to said screen holder by means of a pair of stationary fluted knives having their flutes directed in such a manner that the flow of grains in the treatment chamber is forced downwardly while the stream of grains is pushed upwardly by a screw conveyor provided with an abrasive layer on the forward face thereof, thus producing a high compression of the grains, that are therefore strongly abraded and rubbed both by the screw conveyor abrasive layer and by the screen and rotor assembly, and may therefore be husked and polished in one single machine, although not in one single step, because if husking is desired, the elements of the machine must be adjusted to exercise a stronger action on the grains, whereas if polishing is the preferred function, then the machine must be readjusted to exercise a more gentle action against the grains.

One other grain husking and polishing machine which marks a further advance in the art is that described and claimed in U.S. Pat. No. 4,583,455 also to Salete, that may be regarded as being a remarkable improvement over the machines of the prior art. The general structure of the machine of this U.S. patent is very similar to that of the machine of U.S. Pat. No. 4,292,890, but provides a different type of treatment chamber formed within a specially designed screen and rotor assembly that permits a more efficient rubbing of the grain with a decreased degree of breakage of the same. The screen and rotor assembly of the machine of U.S. Pat. No. 4,583,455 comprises a screen formed by alternate sections of screen material and of abrasive material assembled within a screen holder member which comprises a plurality of vertical channels within which said abrasive sections, which take the form of abrasive blocks, are adjustably mounted. Between each pair of said vertical channels, a corresponding screen section is mounted such that the edges thereof are trapped by said abrasive blocks against the walls of said channels, thus providing alternate abrasive sections for energetically rubbing the grains, spaced between respective alternate sections of screen material to permit the expeditious exit of flour, powder, bran and other impurities of the grain, which are swept by the air circulating through the device; and a rotor which comprises a hollow cylindrical body which is rotatably mounted concentrically within said screen assembly for rotating in unison with a vertical screw conveyor mounted below the above mentioned hollow cylindrical body. The cylindrical body of the rotor is provided with a plurality of radial bores to permit the free passage of air therethrough for sweeping the treatment chamber and also has a plurality of axially extending superficial grooves within each one of which a corresponding abrasive block is mounted to co-act with the abrasive blocks of said screen assembly, said abrasive blocks of the rotor being capable of replacement and of adjustment within the grooves in order to enable the user to adjust the machine for exerting a higher or a lower energetic action to husk and polish the grain passing vertically upwardly of the chamber. By these means, the machine of U.S. Pat. No. 4,583,455 is perfectly capable of performing a husking and a polishing action of the grains in one single step, because the grain stream will be alternately subjected to a strong abrasive and rubbing action between pairs of abrasive blocks, and to a mild rubbing action between a screen section and an abrasive block or a smooth surface of the rotor.

Regardless of the fact that the machines of Salete as described above have represented a considerable advance in the art of grain husking and polishing and have been regarded by the most important grain millers throughout the world as the best machines for this purpose existing in the worldwide marketplace, because any one of said machines accomplish the goals of minimizing grain breakage and the treatment temperature of the grains, thus avoiding agglomeration thereof, considerably decreasing the power consumption per unit of weight of grain treated, providing higher accuracy in the control of the husking and/or polishing operations, etc., which has brought about a considerable improvement in the costs of operation of the mills, as well as an improvement in the quality and uniformity of the treated grain, it is nevertheless to be reminded that very diversified types of grain exist in the producing localities of the world, even for the same species of grain (rice, wheat, corn, etc.) and for the same locality, and that the above described prior art machines are not capable of treating different types and qualities of grain without having to suffer heavy adjustments that therefore require full stoppage of the plant to adjust the machine when a batch of a different grain quality or species is to be treated within the same mill.

Therefore, while very efficient machines are already existing in the market for husking and polishing cereal grains, there remains the need of a machine that may be sufficiently versatile to cope up with the needs of the highly varied types of grains, without however loosing its efficiency for carrying out the husking and/or polishing operations to produce a high quality grain.

BRIEF SUMMARY OF THE INVENTION

Having in mind the defects of the grain husking and polishing machines of the prior art, it is an object of the present invention to provide a grain husking and polishing machine which will be sufficiently versatile to treat grains of different types and qualities without the need of heavy adjustments in the working elements thereof.

One other object of the present invention is to provide a grain husking and polishing machine, of the above described character which will be of a very simple construction and yet will be capable of increasing or decreasing the energy of its rubbing action against the grains without the need of long stop periods of the mill.

Another and more particular object of the present invention is to provide a grain husking and polishing machine, of the above character, that will be capable of alternating, along the treatment chamber, a highly abrasive action and a weakly abrasive but highly rubbing action of the grains against each other.

Still another object of the present invention is to provide a grain husking and polishing machine of the above nature, that will provide for the adjustment of the elements of the machine for increasing or decreasing the effect thereof on the grain, without the need of stopping the machine.

Another and more particular object of the present invention is to provide a grain husking and polishing machine, of the above character, which by very simple means will be capable of forced feeding of grains into the treatment chamber thereof.

The foregoing objects and others ancillary thereto are preferably accomplished as follows:

According to a preferred embodiment, the present invention provides a grain husking and polishing machine which comprises an approximately cylindrical vertical housing divided into four cylindrical sections which are engaged end-to-end by means of suitable fasteners. The first section of said housing is provided with an inner concentrically arranged chamber to serve as a support for a plurality of bearings which in turn rotatably support a hollow axle which extends upwardly through the full lengths of said first section and the second and third sections of said housing. Outwardly of the cylindrical wall of the first section a suitable motor is mounted to rotate said axle by means of a suitable transmission, and an air exhaust chute is also provided within said first section. The second section of said housing is attached to the upper end of said first section and has a concentric cylindrical chamber within which said axle passes, a grain pressurizing screw conveyor being arranged around said axle to extend the full length of said second section, said screw conveyor having a conveyor flight provided with an abrasive material on the attacking surface thereof. A horizontal screw conveyor is attached to the lower part of this section in order to forcedly feed grain into the chamber wherein said vertical screw conveyor is located, said horizontal screw conveyor having a separate motor for rotating the same. The third section of said housing is attached to the top of said second section and is provided with a screen holder which is supported on an annular plate having a pair of diametrically opposed radially extending arms, one of which is pivotally supported on a bolt and the other one of which is engaged to a mechanism for moving the same and consequently the plate and the screen holder to a desired eccentric position with respect to the rotor. The rotor is an abrasive rotor integrally engaged with said axle in order to rotate within a screen assembly attached to said screen holder. The fourth section of said housing is attached to the top of the screen holder and is provided with a grain exit which is closed by means of a weighted lid. The screen assembly preferably comprises alternate sections of screen spaced by sections of abrasive material, said alternate sections being arranged either vertically or horizontally in said screen assembly. The rotor comprises alternate annular sections of abrasive material spaced by means of respective annular non-abrasive sections or spacer rings of a diameter smaller than said abrasive sections and provided with air passages for permitting the passage of air from the hollow interior of said axle to the treatment chamber and outwardly of the screen towards the air exit of the first housing section. Air is admitted at the lower end of said axle to sweep the impurities from said treatment chamber and outwardly of the machine, by means of a pneumatic suction system connected to said air exhaust chute.

BRIEF DESCRIPTION OF THE DRAWINGS

The novel features that are considered characteristic of the present invention are set forth with particularity in the appended claims. The invention itself, however, both as to its organization and its method of operation, together with additional objects and advantages thereof, will best be understood from the following description of certain specific embodiments, when read in connection with the accompanying drawings, in which:

DETAILED DESCRIPTION

Figure 1:
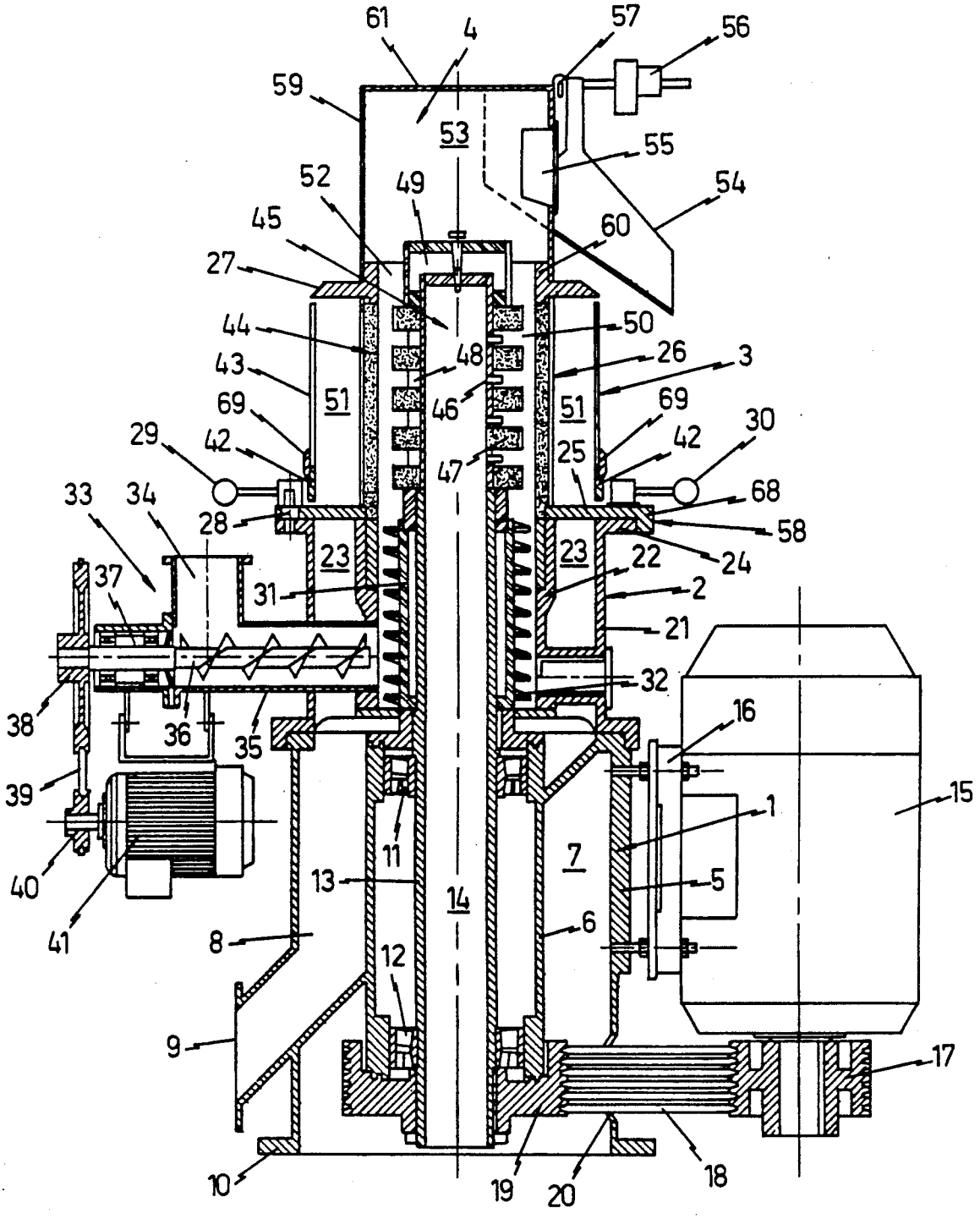
FIG. 1 is a cross-sectional elevational view of a grain husking and polishing machine built in accordance with a preferred embodiment of the present invention.

Having now more particular reference to the drawings and more specifically to FIG. 1 thereof, there is shown a grain husking and polishing machine which essentially comprises a grain treating housing formed by four vertically arranged approximately cylindrical sections 1, 2, 3 and 4 which are engaged in an end-to-end relationship for constituting the grain treating housing of the machine of the present invention.

The lower or first section 1 has an outer cylindrical wall 5 provided with a flange 10 at its lower end, adapted to be attached to a corresponding flange of an air handling box or pneumatic system for drawing an air stream through the machine as will be described hereinafter. Within the outer wall 5 an inner cylindrical wall 6 is arranged to constitute a chamber for supporting a suitable number of bearings, such as the upper ball bearing 11 and the lower ball bearing 12, for rotatively supporting a hollow axle 13. The hollow space 14 of the axle 13 constitutes a duct for conducting air upwardly and into the machine for air sweeping the same. The chamber 7 formed between the walls 5 and 6 is provided at the upper part thereof with an air exhaust chute 8 which constitutes an annular duct for conducting the air and entrained particles outwardly of the machine through an exhaust duct 9 having an appropriate flange for connection to a suitable pneumatic extraction (suction) system (not shown). A motor 15 is mounted by means of a suitable mounting 16 on the outer wall 5 of the lower section 1, for the purpose of rotating the axle 13 through a suitable transmission such as that illustrated in FIG. 1 of the drawings which comprises a motor pulley 17, an axle pulley 19 and a plurality of bands 18 passing through a suitable opening 20. It is to be noted that the chamber 7 is divided into two separate parts by means of the wall of the air exhaust chute 8, whereby the section of wall 5 which is provided with the opening 20 is not exposed to the air stream sweeping the machine, considering that the air drawn through the hollow axle 13 derives from the above mentioned pneumatic extraction system (not shown) which draws by suction said air directly into the hollow space 14 of the axle without any direct communication with chamber 7.

The next housing section 2 is engaged to the upper edge of wall 5 of section 1 by any suitable means and comprises an outer cylindrical wall 21 and an inner cylindrical wall 22 for forming a chamber 23 which constitutes an annular duct for conducting exhaust particle laden air downwardly into the exhaust chute 8 of housing section 1. Within the inner wall 22 through which the hollow axle 13 passes, a screw conveyor 31 is arranged to be integrally attached to axle 13 for rotating in unison therewith. The screw conveyor 31 has a helical flight or ribbon 32 the attacking or frontal surface of which may be provided with an abrasive material to exercise a more energetic rubbing action on the grain for loosening the hull thereof.

On the lower part of wall 22 a horizontal grain feeder generally designated by the reference numeral 33 is connected. Said feeder 33 comprises a horizontal duct 35 which is introduced through the outer wall 21 of housing section 2 and is welded or otherwise hermetically engaged to the inner wall 22, so as to isolate the grain stream from the air conducting chamber 23. The horizontal duct 35 is connected with a vertical duct 34 having an appropriate flange for connection with a grain storage facility (not shown) from which the grain is taken by feeder 33 to feed the machine. A suitable journal 37 is attached at the free end of duct 35 for rotatively supporting the shaft of the screw conveyor 36. Said shaft receives its drive from a shaft pulley 38 arranged outwardly of duct 35 as shown in FIG. 1 and drivingly connected by means of suitable bands 39 to the pulley 40 of a suitable motor 41 exteriorly mounted on said horizontal duct 35 by any suitable means.

The third consecutive housing section 3 is mounted at the upper edge of the outer wall 21 of section 2 by any suitable attaching means, with the exception of two oppositely arranged slits through which the tongues of a plate 25 to be described in more detail hereinafter extend outwardly of the housing. Said housing section 3 comprises an outer lower wall 42 which is attached to the flange 24 of wall 21 and an outer upper wall 43 which is an integral continuation of wall 42 but made of a transparent material to permit the observation of the materials within the chamber 51 formed between said wall 43 and the screen holder 26.

A movable eccentricity adjusting annular plate 25 which will be described in more detail hereinbelow is pivotally mounted on flange 24 of wall 21 by means of a suitable bolt 28 and is provided, at its other end, with a displacement mechanism generally indicated by means of reference numeral 58 which will be described in more detail hereinbelow. The annular plate 25 is integrally attached to the screen holder 26 as well as to the top cover 27 of housing section 3, said top cover 27 being free from any attachment to the outer transparent wall 43 of housing section 3. The opposite end arms 65 and 66 of plate 25 are provided with respective tightening levers 29 and 30 for the purpose of firmly fixing its selected position with respect to the remainder of the elements of the machine. By this means, the eccentricity of the screen holder 26 may be adjusted at will within reasonable limits, for a purpose that will be clear from the description of the operation of the machine that will be given hereinafter.

The above described screen holder 26 supports a cylindrical screen assembly 44 formed by alternate sections of abrasive material and of screen material and, within said screen assembly, the axle 13 which passes through housing section 3 is provided with a rotor generally indicated by reference numeral 45 which constitutes a continuation of said axle 13. Although the rotor 45 for the machine of the present invention may adopt many different configurations, in accordance with the preferred embodiment of the present invention said rotor comprises a plurality of abrasive rings 47 mounted on the axle 13, spaced by a corresponding plurality of spacer rings 79 or axle sections 48 preferably of increased thickness, said spacer rings and/or thickened axle sections being provided with radial bores 46 for the passage of sweeping air. The top of the rotor 45 is closed by means of a suitable cover 49.

The fourth or top housing section 4 is formed by a cylindrical wall 59 which is attached to a cylindrical extension 60 of the cover 27 of section 3 by means of a pressure fit or the like, and a top cover 61 for forming a cylindrical chamber 53. This chamber 53 is communicated with the treatment chamber 50 formed between the screen assembly 44 and the rotor 45, by means of an annular passage 52 formed between the cylindrical extension 60 of cover 27 and the cover 49 of the rotor 45. The cylindrical wall 59 of housing section 4 is provided with a suitable grain discharge opening covered by a weighted lid or damper 55 hinged to said cylindrical wall 59 by means of the hinge 57 and forced permanently to its closed position by the weight device 56. A chute 54 is provided under the grain discharge opening to lead the discharged grain outwardly of the machine.

A very important feature of the present invention resides on the provision of the above mentioned eccentricity adjusting mechanism which permits the displacement of the screen assembly with respect to the rotor in order to adjust the relative positions of said elements either in an accurately concentric position of the rotor 45 with respect to the screen assembly 44 or in an eccentric position which may vary within the limits of approximately 5 millimeters from the center or the rotor to the center of the screen assembly in both directions of displacement of the screen assembly.

Figure 2:
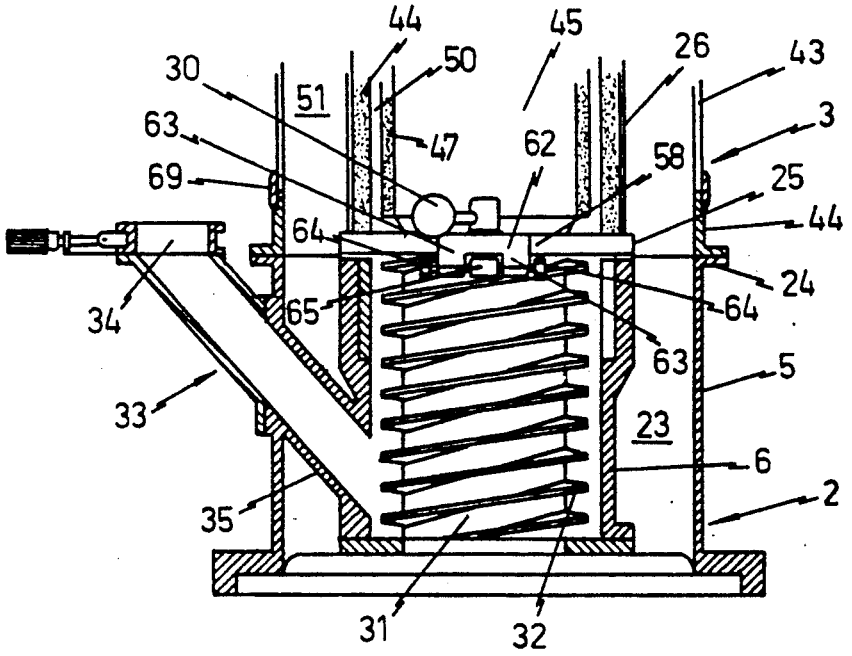
FIG. 2 is a cross-sectional fragmentary elevational view of the second and third housing sections of a grain husking and polishing machine built in accordance with another embodiment of the invention, showing the structure of the feed chute and the eccentricity adjusting mechanism thereof.
Figure 4:
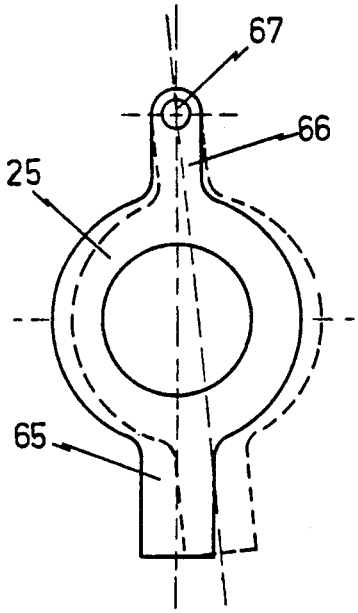
FIG. 4 is a diagrammatic view of the eccentricity adjusting mechanism showing in an exaggerated scale, the manner in which it is displaced to vary the eccentricity of the screen with respect to the rotor.
Figure 3:
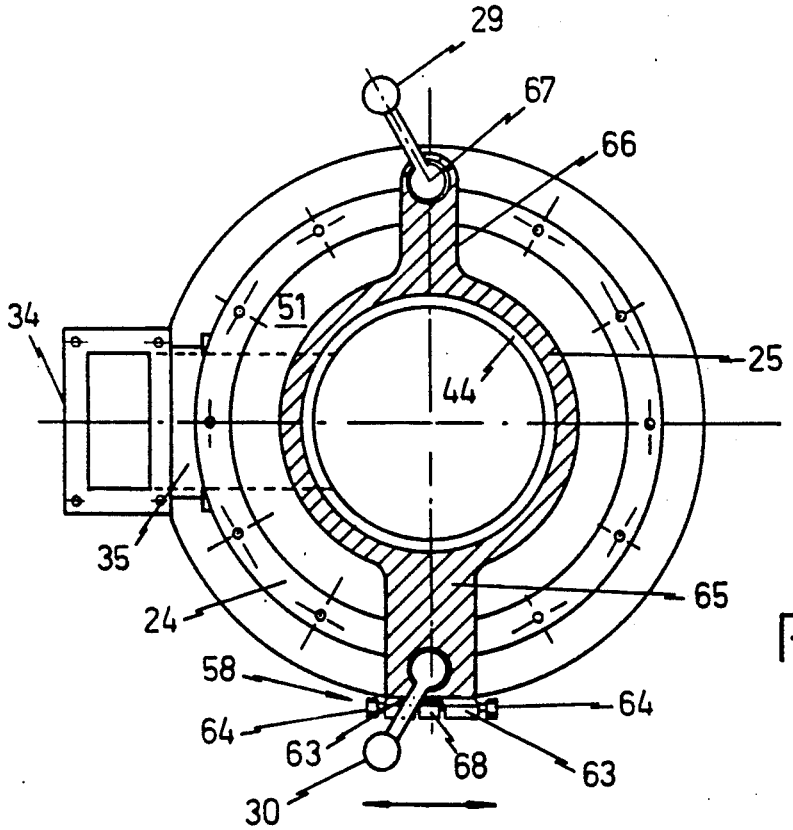
FIG. 3 is a fragmentary cross-sectional plan view of the eccentricity adjusting mechanism shown in FIG. 2.

The eccentricity adjusting mechanism is more clearly illustrated in FIGS. 2, 3 and 4, wherein said mechanism is shown as applied to a grain husking and polishing machine built in accordance with U.S. Pat. No. 4,583,455 for merely illustrative purposes, inasmuch as it is to be understood that said eccentricity adjusting mechanism may be used in conjunction with any other type of air-swept husking or polishing machine for grains.

The eccentricity adjusting mechanism of the present invention comprises, as already described above, an annular plate 25 arranged between housing sections 2 and 3 as more clearly illustrated in FIG. 2 of the drawings, to which plate 25 the screen holder 26 with its screen assembly 44, and the cover 27 of housing section 3 are integrally attached. Plate 25, as more clearly illustrated in FIG. 3 of the drawings, is provided with two radially outwardly extending arms 65 and 66, both of which, as already explained in connection with FIG. 1, extend for a distance outwardly of wall 44 of housing section 3. The arm 66 of plate 25 is pivotally supported on the flange 24 of wall 5 of housing section 2, as more clearly illustrated in FIG. 1, by means of a suitable bolt 67 which is provided with a tightening mechanism including a tightening lever 29 which releases the arm 66 for free rotation thereof about bolt 67 in one position of said lever 29, and which tightens said arm 66 at a predetermined selected position by moving the lever to a second or tightening position. The opposite arm 65 of plate 25 is provided with an end tongue 68 which is received within an eccentricity varying assembly designated in FIGS. 1 and 2 by means of the reference numeral 58, as well as with another tightening mechanism 30 identical with mechanism 29 described above.

The eccentricity varying assembly 58 comprises a fork 62 firmly attached to flange 24 and having at each end thereof a perpendicular lug 63 each provided with a threaded bore extending perpendicularly thereto and with respective threaded bolts or screws 64 introduced within each bore so that the tips of said threaded bolts abut against the sides of said tongue 68. By these means, if one of the threaded bolts 64 is tightened whereas the other one is loosened, the tongue 68 will be moved towards the left or towards the right as indicated by the double arrow of FIG. 3.

FIG. 4, on the other hand, is a diagrammatic view of the plate 25 for merely showing, in an exaggerated manner, the type of movement imparted thereto by the threaded bolts 64. The full line position indicates the accurately centered position of the plate, whereas the broken line position indicates the extreme eccentric position of the plate towards the right. It will be obvious that it is also possible to move the plate 25 towards the left by an equal angle. The extent of the above described movement is of approximately 5 millimeters both towards the right or towards the left of the center position for any type of grain husking and/or polishing machine, in order to accomplish the desired results.

Although the eccentricity adjusting mechanism may be operated efficiently by merely adjusting the position thereof by tightening one of the threaded bolts 64, while the other threaded bolt is fully loosened to permit the free travel of the tongue 68 towards the direction of the loosened bolt, it is preferred to operate this mechanism by adjusting both threaded bolts in order to very firmly keep the selected position of the tongue, regardless of any vibrations produced by the machine. The combination of the tightening action of the tightening levers 29 and 30 and the fixation action of the pair of threaded bolts 64, will keep the assembly perfectly pressed in its selected eccentric or concentric position, whereby the eccentricity of the screen holder and screen assembly with respect to the rotor will remain constant during the selected period of operation. It will also be clear that the eccentricity adjusting mechanism of the present invention will permit to effect changes in the eccentricity with the machine in operation, thus rendering it possible to change the characteristics of the husking and polishing actions of the machine to match the necessities of the grains that are being fed to the machine, without the need of stopping the machine for effecting changes in the distance between the screen assembly 44 and the rotor 45 to either increase or decrease the rubbing action on the grains fed to the machine, thus enabling the machine to treat grains of different types or qualities, without the need of stopping the machine.

As mentioned above, the eccentricity adjusting mechanism described above may be used with any type of air-swept grain husking and/or polishing machine, such as those described and claimed in the patents mentioned in the chapter of "Background of the Invention" incorporated by reference in the instant application, and not only with the machine illustrated in FIG. 1 of the drawings. The eccentricity adjusting mechanism, therefore, has been illustrated in FIG. 2 of the drawings as used with a machine having a gravity feeder for the grains which comprises an inclined chute 33 (equivalent to the mechanical feeder 33 of FIG. 1) having an adjustable flange 34 for connection with a suitable grain containing hopper or the like (not shown). The screen and rotor assembly 44, 45 of FIG. 2 is as shown in U.S. Pat. No. 4,583,455, wherein the rotor 45 comprises a solid cylindrical body having a plurality of vertical grooves within which a corresponding plurality of adjustable abrasive blocks 47 are contained, and the screen assembly 44 comprises a plurality of vertically arranged abrasive sections spaced between a corresponding plurality of alternated screen sections. The adjustment of eccentricity accomplished by the mechanism described above will permit the screen assembly to be placed nearer or farther away from the abrasive blocks of the rotor at one circumferential point of the treatment chamber 50, with which the abrasive effect will be increased or decreased, respectively, thusly intensifying or weakening the husking or the polishing effect of the machine, which action has been found highly convenient when treating rice grains.

Another extremely important feature of the present invention is the screen and rotor assembly 44, 45 of the machine, which is illustrated in FIGS. 1 and 5 to 12 of the drawings, to which reference will be had hereinbelow.

Although the screen and rotor assembly illustrated in FIGS. 5 to 12 of the drawings may be used for husking and/or polishing a large variety of cereals and grains, which include but are not limited to rice, wheat, soya, sunflower, saffron and the like, it has been found that said novel screen and rotor assembly is highly suited for husking and polishing rice grains, whereby the following discussion will refer to said grains without any intention of restricting the true spirit and scope of the invention.

For the purpose of ascertaining the behavior of many different types of rice grains produced throughout the world, applicant has carried out an extensive experimentation, from which it may be concluded that there are rice types that respond best to direct abrasion against the hard parts of the machine, than to the rubbing action between grains, and vice-versa. Therefore, the rotor shown in the above mentioned figures of the drawings was designed in order to provide a device that, by the mere reversal of its attack position with respect to the sense of rotation thereof, could be able to provide the appropriate effect for each said type of rice, by either preferentially increasing or decreasing the abrasion or the rubbing effect, but without however suppressing the other of said effects in a complete manner.

By forcing the mass of grains within the treatment chamber of the machine of the present invention, to rotate following the movement of the rotor, the grains are abraded against the static abrasive elements of the screen assembly and therefore the maximum degree of abrading action is obtained. This effect may be considered as the main action on the grains, which removes the first layers of fat and husk from the grains, and with the addition of the rubbing effect described above, the complete husking and polishing of the grains is easily obtained. It must be pointed out, however, that although the rotor must not necessarily be abrasive, it is highly convenient to provide the same with a harsh surface, so that the grains will tend to adhere thereto and be rotated following the rotation of the rotor. Therefore, the use of abrasive materials for building the rotor of the machine of the present invention will aid in providing an abrading effect which will accelerate the "scratching" of the grains to remove the hull, but other non-abrasive materials may be used as well, provided that such materials present the harsh surface mentioned above. Said materials may include hard rubber, polyurethane or metallic materials such as steel or iron and the like.

Considering the above, the present invention provides a novel rotor having a configuration such that, besides considerably increasing the processing capacity of the machine as well as the efficiency of the polishing operation, will also be capable of easily modifying the polishing effects, through the mere reversal of its attack position, so that said effects be more abrasive than rubbing, or more rubbing than abrasive, depending on said attack position, which will also render it possible to obtain grains having surfaces of higher or lower smoothness. The novel rotor of the present invention also permits a better circulation of the sweeping air through the mass of grains, which permits the production of a colder product having less superficially adhered spots of flour or bran on the grains.

Having now more particular reference to FIGS. 5 and 6 of the drawings, there is shown a screen and rotor assembly housed within housing section 3, which comprises a lower cylindrical wall 42 which is attached to housing section 2 as described in connection with FIG. 1 of the drawings, with the exception of two oppositely disposed slits 77 and 78 which are provided to permit the arms 66 and 67 of plate 25 of the eccentricity adjusting mechanism to extend outwardly of wall 42 for the purpose already described above. The lower wall 42 is joined, by means of a suitable attaching band 69, to an upper cylindrical transparent wall 43 which is provided in a position suitable to enable the user to watch the interior of chamber 51 to judge the operation of the device.

Mounted on axle 13 as described in connection with FIG. 1, is a rotor 45 built in accordance with the preferred embodiment of the invention, which comprises a plurality of abrasive rings 47 the structure of which will be described in more detail hereinafter, spaced from each other by any suitable means, such as by spacer rings as those shown at 79 in FIGS. 11 and 12, or by thickened sections 48 of axle 13 as shown in FIG. 1, in order to provide reduced diameter non abrasive sections 48 through which a plurality of bores 46 communicate the hollow interior 14 of axle 13 with the treatment chamber 50 for permitting the air to thoroughly sweep through the screen and remove the dust, flour and bran produced by the machine, towards the exit chamber 51. The reduced diameter spacer rings or thickened axle sections described above, which have a diameter smaller than the discs 47, will provide a plurality of expansion chambers wherein the grain pressure is released and therefore the compacted mass of grain is loosened for permitting a more free flow of the air to sweep therethrough and more efficiently entrain the particles released from the grains by the abrading and rubbing action of the screen and rotor assembly.

Figure 5:
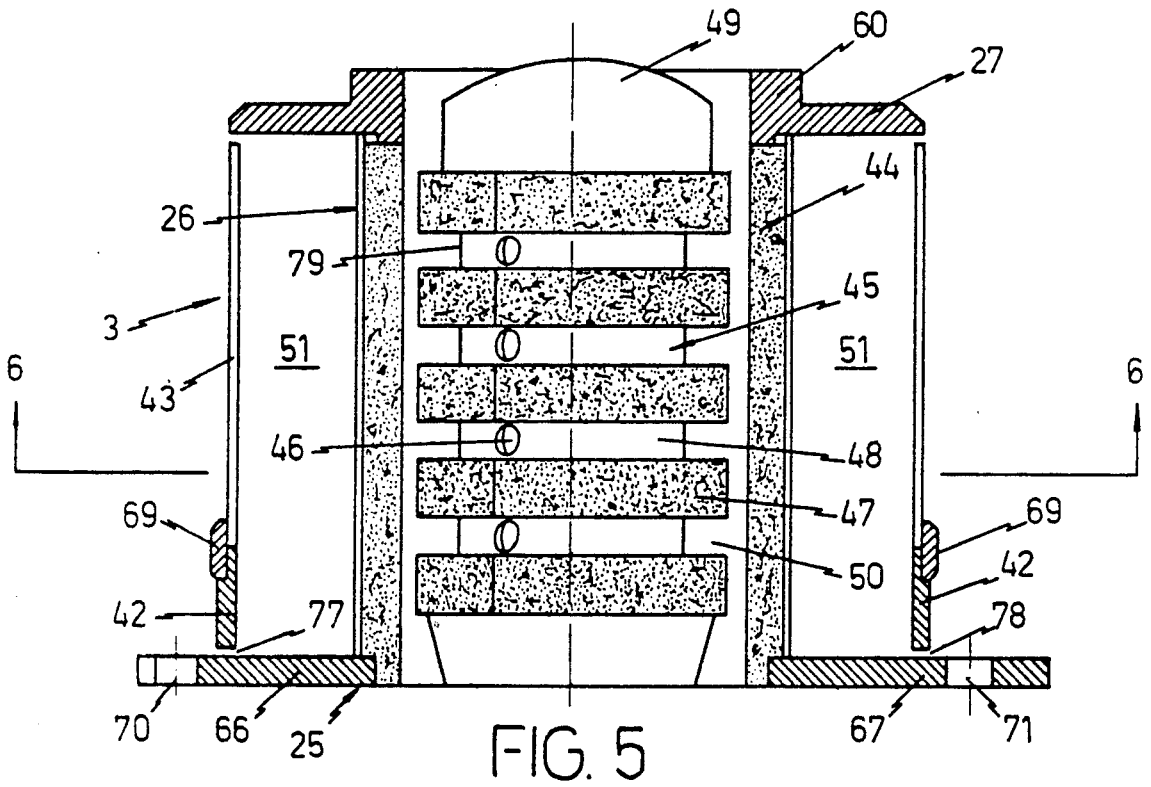
FIG. 5 is a fragmentary cross-sectional elevational view of the third housing section, showing a preferred embodiment of the screen and rotor assembly.
Figure 6:
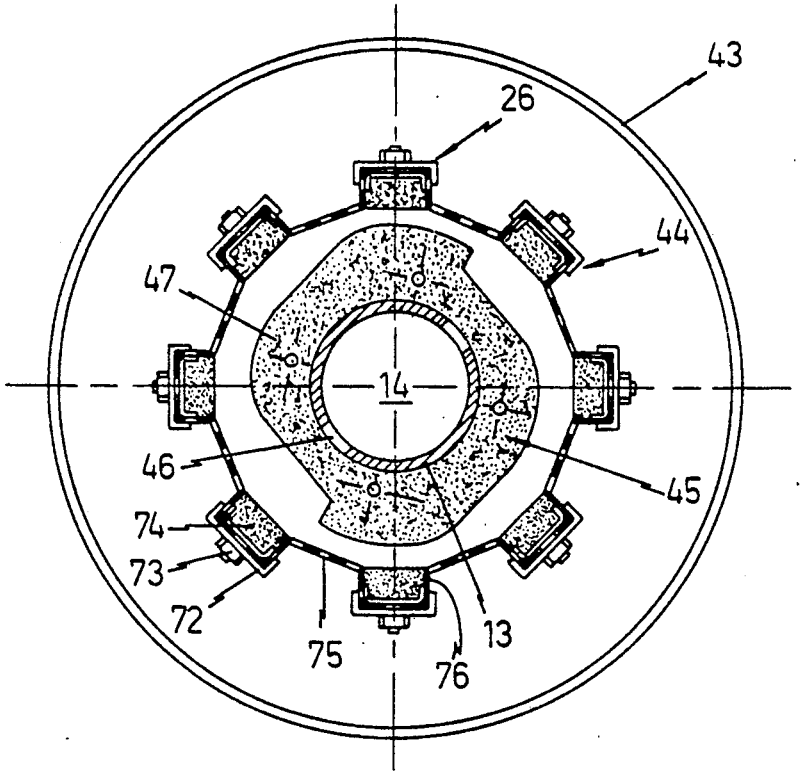
FIG. 6 is a cross-sectional view taken along lines 6—6 of FIG. 5 and looking in the direction of the arrows.

The screen assembly 44 of the embodiment shown in FIGS. 5 and 6 comprises a screen holder 26 which is formed by means of a plurality of vertical channel members 72 which may be attached to each other by any suitable means such as the cover 27 at the top thereof and the plate 25 at the bottom thereof, in order to constitute an integral unit therewith. Within the channel members 72 and supported by means of adjustable threaded bolts 73 there is arranged a corresponding plurality of abrasive blocks 74 the radial position of which may be adjusted by means of the threaded bolts 73 in order to increase or decrease the gap between said abrasive blocks 74 and the rotor abrasive discs 47 as shown in FIG. 6. The rotor 45 is provided at the top thereof with a suitable cover 49 for fixing the position of the abrasive discs 47 and spacer rings 79. The structure of the screen assembly 44 is complemented by means of a plurality of vertically arranged screen sections 75 alternated between each pair of abrasive blocks 74 and fastened to the channel members 72 of the screen holder 26, by means of side angular screen flanges 76 introduced between the block 74 and the bottom of the channel member 72.

Figure 7:
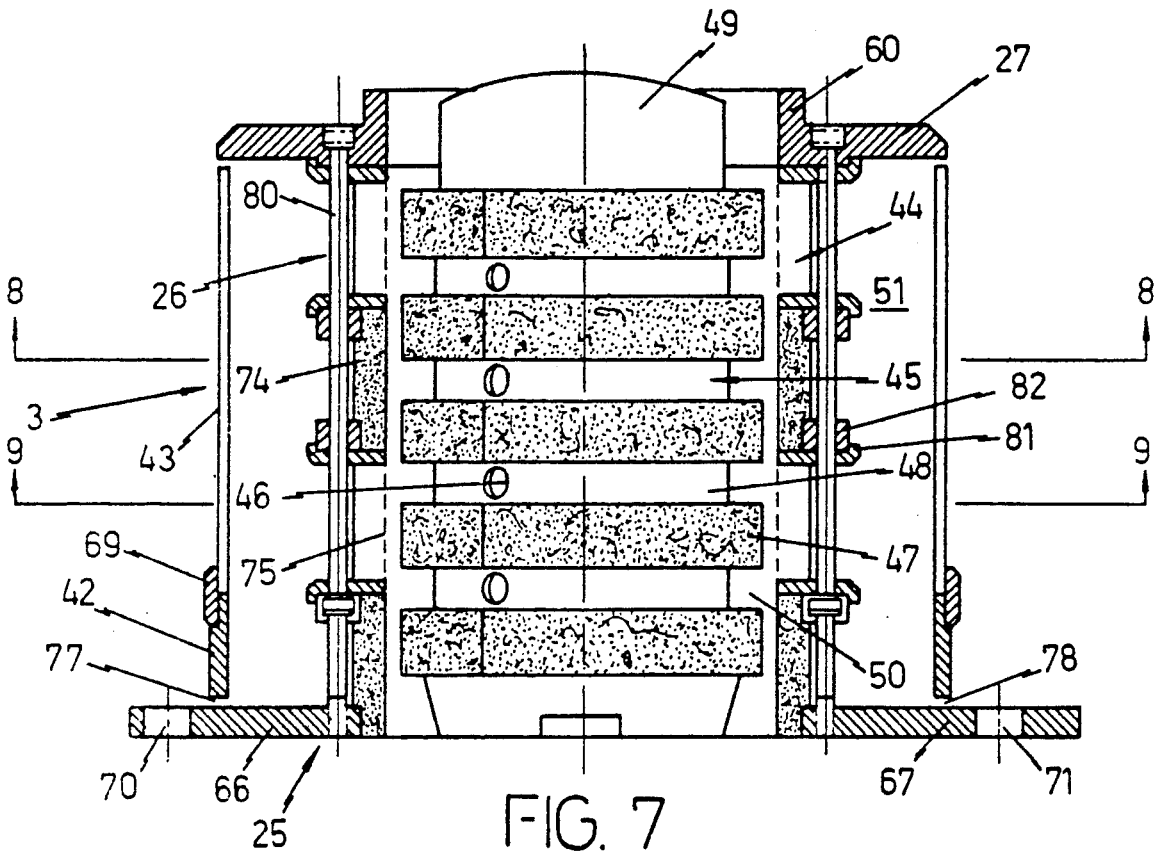
FIG. 7 is a fragmentary cross-sectional elevational view of the third housing section, showing a further embodiment of the screen and rotor assembly.
Figure 8:
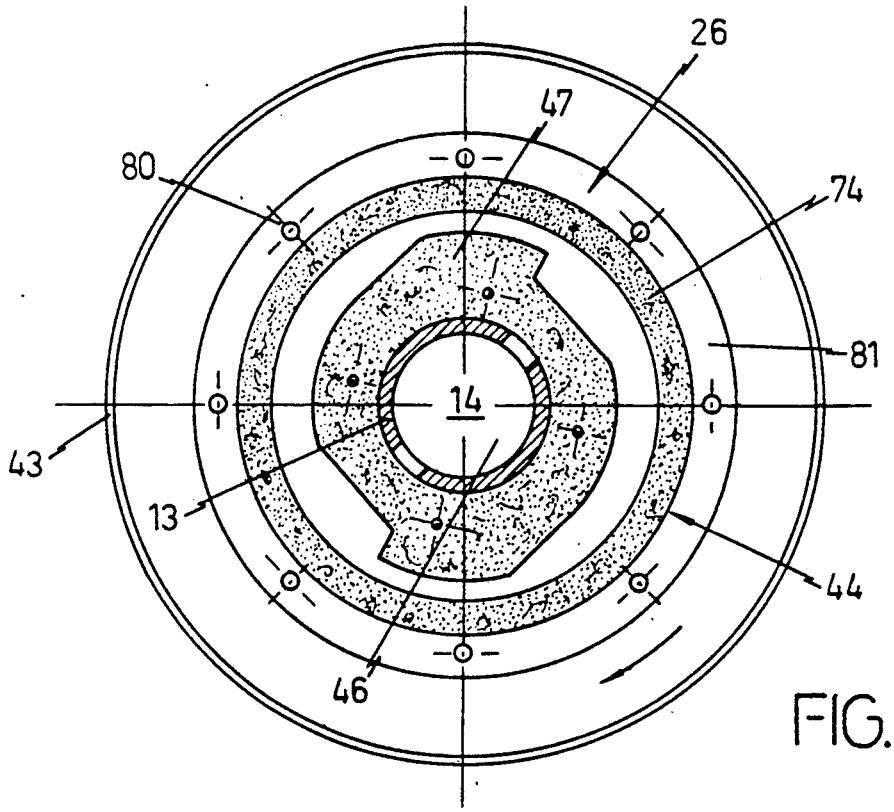
FIG. 8 is a cross-sectional view taken along lines 8—8 of FIG. 7 and looking in the direction of the arrows.
Figure 9:
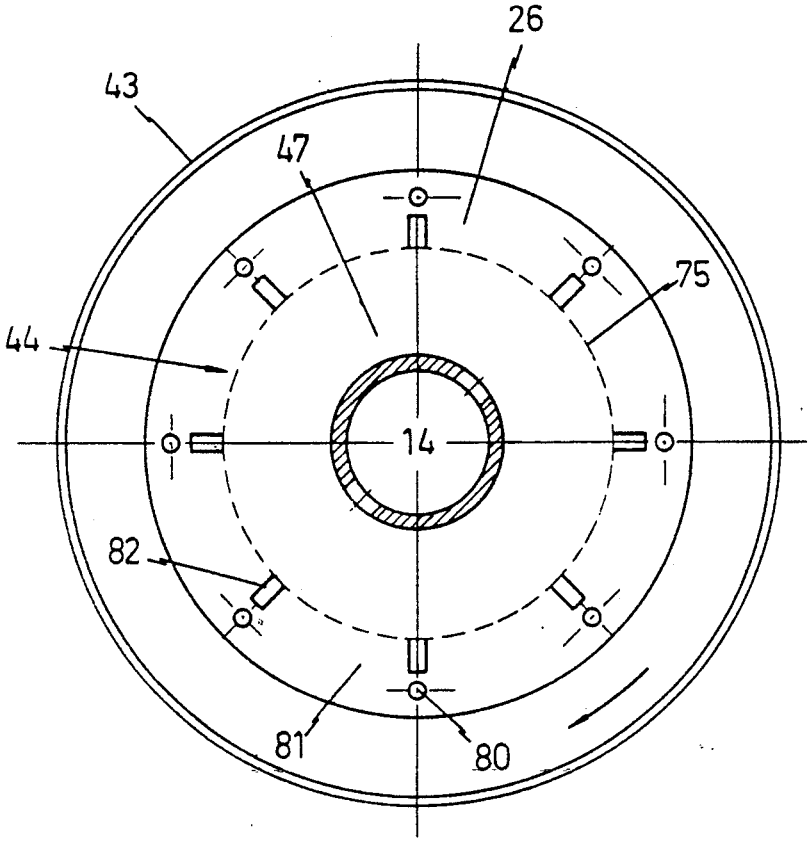
FIG. 9 is a cross-sectional view taken along lines 9—9 of FIG. 7 and looking in the direction of the arrows.

FIGS. 7, 8 and 9 of the drawings show another embodiment of the invention, in which the rotor is identical with the rotor described in connection with FIGS. 5 and 6, but with a modified screen assembly 44 which comprises a screen holder 26 constituted by a plurality of rods 80 firmly joined at their top within suitable bores in the cover 27 and joined at their bottom within suitable bores in the plate 25 as shown in FIG. 7. A plurality of horizontal annular plates 81 are distributed along the height of said rods 80 and are supported thereby to in turn support a plurality of brackets 82 for fixing a plurality of annular abrasive blocks 74 as shown in FIG. 8. A plurality of cylindrical screen sections 75 is alternately arranged between each pair of abrasive blocks 74 and fixed between corresponding pairs of annular plates 81. This embodiment of the invention permits to carry out the husking and polishing operations in progressive stages, inasmuch as the grain, in its ascending movement through the treatment chamber 50, will firstly be abraded between the lowest rotor disc 47 and the lowest annular abrasive block 74 of the screen assembly 44, to thereafter permit the exit of the dust and bran released, through the screen section 75 which follows upwardly, and so forth until the grain passes the full length of the treatment chamber 50.

Figure 10:
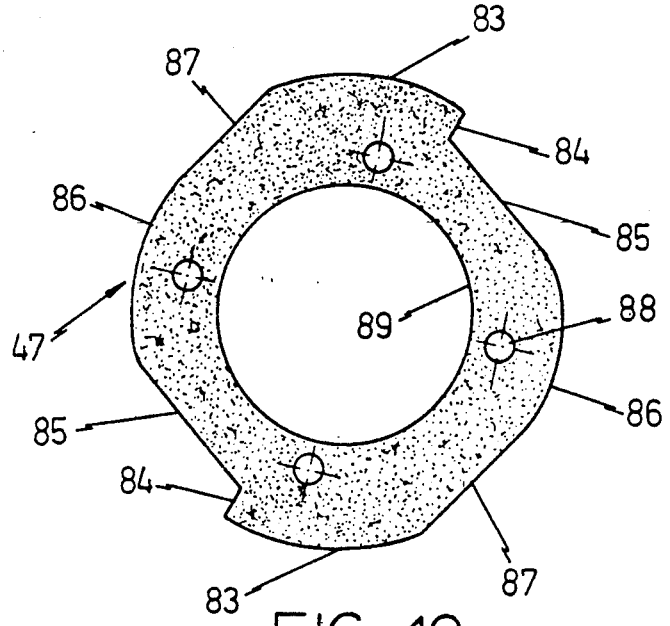
FIG. 10 is a plan view of an individual abrasive impeller disc for use in the rotor of the machine of the present invention.
Figure 11:
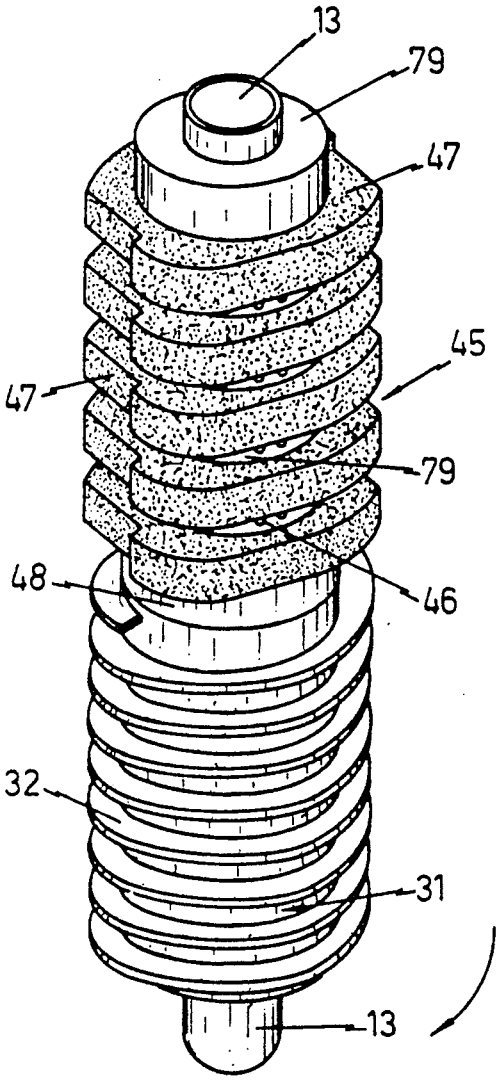
FIG. 11 is a perspective view of the rotor built in accordance with the preferred embodiment of the invention and showing the abrasive impeller discs in a positive action position with respect to the sense of rotation thereof.
Figure 12:
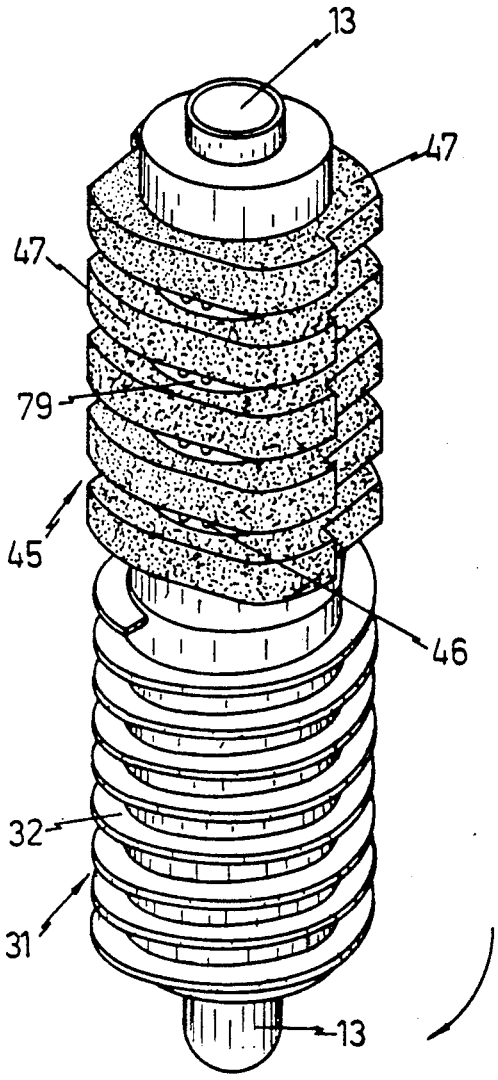
FIG. 12 is a view similar to FIG. 11, but showing the abrasive impeller discs in a negative action position with respect to the sense of rotation thereof.

The highly improved action of the rotor built in accordance with the preferred embodiment of the invention will be clarified by having now reference to FIGS. 10, 11 and 12 of the drawings, which show the structure of each disc used in the rotor, as well as the arrangement of said discs along the length of said rotor.

The discs 47 of the preferred embodiment of the present invention, are built of an abrasive material, although as already mentioned above, said discs may be also built of other materials, provided that the condition is met that they have a harsh surface to provide adherence of the grains thereto, so that the said grains are efficiently driven around the axis of the machine.

As shown in FIG. 10 of the drawings, each disc 47 is provided with a central opening 89 for mounting thereof around the hollow axle 13 and a plurality of bores 88 for fixing said discs together with the spacer rings 79 in the form of a unit on said axle 13 for rotation therewith. The periphery of the disc 47 is arranged, in accordance with the preferred embodiment shown in the drawings, in the form of a cam the contour of which is repeated each half circumference of the disc. The periphery of said disc, therefore, is a circumferential surface 86, which has been modified in two diametrically opposed sections thereof by providing a curved outwardly ascending section 87 for communicating said circumferential section 86 with a circumferential lobe 83 having a diameter larger than section 86. The maximum diameter circumferential lobe 83 is continued with a radially inwardly directed surface 84 which forms a shoulder on the cam surface of the disc 47 and, from the inner end of said shoulder 84, the cam surface is completed by means of a relatively flat section 85 the other end of which is joined with the diametrically opposed circumferential section 86, the contour described above being repeated throughout the other half of the circumference of the cam surface of the disc 47.

Depending on the position in which the discs 47 are mounted on the axle 13 which rotates in the direction indicated by the arrow in FIGS. 11 and 12, said discs will carry out an abrasive or positive action on the grains under treatment, or a centrifugating or negative action on said grains, such as is illustrated in FIGS. 11 and 12 of the drawings, respectively.

FIG. 11 illustrates the discs 47 mounted such that, when the thusly formed rotor 45 rotates in the direction of the arrow, said discs 47 will exert, in view of the forward attack position of the shoulders 84, a drag or pushing effect on the grain (positive action), which will augment the strength of the husking or polishing action, by virtue of the stronger abrasion applied thereto, whereas in the position of the discs 47 indicated in FIG. 12, wherein the shoulders 84 are arranged in a backward attack position, said discs will exert a centrifugal effect on the grain (negative action), which diminishes the strength of the polishing or husking action.

It will be obvious to any one skilled in the art that the opposite arrangements of the discs 47 illustrated in FIGS. 11 and 12, may be modified at will in view of the separate mounting of each disc on the axle 13, by alternating the positions of the discs in any possible arrangement for providing individual positive or negative actions of the discs, so as to accomplish any desired effect for polishing or husking grains. Therefore, it will be clear that the particular construction of the preferred embodiment of screen and rotor assembly described above, permits the obtention of a broad variety of husking or polishing effects which render the machine of the present invention highly versatile to treat different types or species of cereals or grains, without the need of modifying the machine itself. For instance, the discs 47 may be arranged so that all of them be in the positive attack position shown in FIG. 11, or may be arranged so that all of them be in the negative attack position shown in FIG. 12, or also said discs may be arranged individually in any alternative position between said two extreme arrangements, in order to obtain a broad variety of different effects on the grain under treatment. The combination of the screen assemblies shown in FIGS. 5 and 7 with the rotor described above, on the other hand, also provides for a still broader variety of actions of the machine. For instance, if the screen assembly 44 of FIGS. 7–9 of the drawings is combined with a rotor 45 containing a set of discs arranged in alternate opposite positions along the rotor, such that discs in a positive attack position as defined above are confronted with the abrasive rings 74 of the screen assembly and discs in a negative attack position are confronted with screen sections 75 of the screen assembly, the grains upwardly fed into the treatment chamber 50 will firstly pass through a section wherein a very energetic husking action will be applied thereto, to thereafter be released when passing through the spacer ring 79 which follows, in order to permit the release of the husk and bran produced in the first stage, to thereafter pass to the screen section of the screen assembly, where the negative attack disc will exert a milder but effective polishing action on the previously husked grains, and so on throughout the full length of the treatment chamber until the desired degree of husking and polishing of the grain is obtained, depending on the number of stages provided.

The grain husking and/or polishing machine built in accordance with the present invention operates in the manner which is traditional for most of the air-swept type of husking and/or polishing machines, that is, simultaneous streams of air and grain are fed to the machine to pass therethrough in predetermined pathways as follows:

A continuous mass of grains is fed through the mechanical or manual feeder 33 to the lower portion of the second housing section 2 of the machine, to be picked up by the screw conveyor 31 which compresses the grain and forces it into the treatment chamber 50 in housing section 3, where the grain is husked and/or polished between the rotor 45 and the screen assembly 44, thus releasing dust, flour and bran. The treated and clean grain is pushed upwardly through the annular passage 52 into the top section 4 of the machine, wherein the grain under certain pressure forces the weighted lid or damper 55 to the open position thus allowing the grain to leave the machine through the discharge chute 54 for being received in the storage or in the packaging areas of the mill.

On the other hand, a stream of air under a moderate negative pressure in introduced by any suitable means, such as by a pneumatic suctioning system (not shown) applied to the exhaust duct 9 of the machine, into the hollow space 14 of the axle 13 to flow upwardly of the machine. The air leaves the hollow space 14 through the plurality of bores 46 provided in the rotor section 45 of said axle 13 to thoroughly sweep the entire volume of the treatment chamber 50. In view of the fact the air flowing through the machine is under a moderate negative pressure, air will not be permitted to flow outwardly of the machine through the weighted lid 55 and instead will be forced to pass transversely through the treatment chamber 50 at the same time entraining the dust, flour and bran produced in said treatment chamber as described above. The particle laden air flows outwardly of the treatment chamber 50 through the openings of the screen sections 75 of the screen assembly and into the annular chamber 51 in housing section 3 of the machine, to thereafter pass through the annular chamber 23 of housing section 2 and finally to the exhaust chute 8 of housing section 1 to exit the machine through the exhaust duct 9, to be sent to the above described pneumatic suction system for recovery of the flour and bran and removal of the dust from the air, as is the normal practice in grain mills.

Although certain specific embodiments of the present invention have been shown and described, it is to be understood that many modifications thereof are possible. The present invention, therefore, is not to be restricted except insofar as is necessitated by the prior art and by the spirit of the appended claims.

What is claimed is:

1. An air-swept grain husking and/or polishing machine which comprises an approximately cylindrical housing longitudinally divided into first, second, third and fourth intercommunicated longitudinal sections, a hollow axle arranged concentrically within said housing and rotatively mounted on bearing means mounted within an isolated chamber concentrically arranged within said first housing section, said hollow axle extending throughout the length of said first, second and third housing sections, rotational driving means attached to the end of said hollow axle outwardly of said isolated chamber, air inlet means connected to the driven end of said hollow axle for permitting a stream of air to be drawn into the hollow space of said hollow axle, grain pressurizing screw conveyor means mounted on said axle within a concentric chamber arranged in said second housing section, grain feed means for feeding a continuous mass of grain into said concentric chamber of said second housing section to be picked up by said screw conveyor means, abrasive rotor means mounted on said hollow axle next to said screw conveyor means and within said third housing section, screen means mounted on means for adjusting the eccentricity thereof with respect to said hollow axle and to said rotor means, said screen means comprising a plurality of screen sections spaced by means of a corresponding plurality of alternated abrading sections, said screen means being mounted within said third housing section in confronted relationship with said rotor means, said eccentricity adjusting means comprising an annular plate having a pair of diametrically opposed arms, the free end of one of said arms being pivotally mounted on said housing and the opposite arm thereof being engaged by a plate sidewardly displacing mechanism for moving said arm towards any one of two sideward opposite directions, whereby said screen means mounted on said plate will be moved sidewardly to adjust the eccentricity thereof with respect to said axle and rotor means in order to vary the strength of the abrading action exerted on the grain by said abrasive rotor and said screen means, grain outlet means on the cylindrical wall of said fourth housing section, said outlet means being plugged by a weighted lid, particle laden air outlet means constituted by the annular spaces formed between the outer walls of said third and second housing sections, and said screen means in said third housing section and said concentric chamber in said second section, and particle laden air exhaust chute means arranged within said first housing section and adapted to be connected to air suction means.

2. A machine as claimed in claim 1 wherein said grain feed means comprise horizontal duct means connected to the inner chamber of said second housing section, screw conveyor means within said horizontal duct means, said horizontal screw conveyor means having a shaft extending outwardly of said horizontal duct means, driving means engaged to the end of said shaft outwardly of said horizontal duct means, and vertical duct means connected to said horizontal duct means to feed grain by gravity to said screw conveyor means.

3. A machine as claimed in claim 1 wherein said grain feed means comprise inclined duct means connected to the inner chamber of said second housing section, to feed grain by gravity of said screw conveyor means mounted on said hollow axle of the machine.

4. A machine as claimed in claim 1 wherein said screw conveyor means mounted on said hollow axle of the machine comprises a helical ribbon with smooth surfaces on both faces thereof.

5. A machine as claimed in claim 1 wherein said screw conveyor means mounted on said hollow axle of the machine comprises a helical ribbon having a smooth back face and an abrasive front or attack face.

6. A machine as claimed in claim 1 wherein said plate sidewardly displacing mechanism comprises a fork mounted on said housing, said fork having a perpendicularly arranged lug at each end thereof, said arm of said annular plate being arranged so that its free end is placed between said lugs, and a screw transversely arranged in each one of said fork lugs, with the tips thereof directed inwardly of the fork and abutting against the sides of the end of said arm, whereby when one of said screws is tightened while the other one is loosened, said arm will be sidewardly displaced to adjust the eccentrically of said annular plate and of the screen assembly mounted thereon, with respect to said hollow axle and said rotor means.

7. A machine as claimed in claim 1 wherein said screen means comprises screen holder means, a plurality of vertical abrasive elongated blocks arranged along the circumference of said screen holder means, and a corresponding plurality of vertical screen sections alternately arranged between each pair of abrasive blocks.

8. A machine as claimed in claim 1 wherein said screen means comprises screen holder means, a plurality of abrasive rings arranged horizontally along the length of said screen holder means, and a corresponding plurality of cylindrical screen sections alternatively arranged between each pair of abrasive rings.

9. An air-swept grain husking and/or polishing machine which comprises an approximately cylindrical housing longitudinally divided into first, second, third and fourth intercommunicated longitudinal sections, a hollow axle arranged concentrically within said housing and rotatively mounted on bearing means mounted within an isolated chamber concentrically arranged within said first housing section, said hollow axle extending throughout the length of said first, second and third housing sections, rotational driving means attached to the end of said hollow axle outwardly of said isolated chamber, air inlet means connected to the driven end of said hollow axle for permitting a stream of air to be drawn into the hollow space of said hollow axle, grain pressurizing screw conveyor means mounted on said axle within a concentric chamber arranged in said second housing section, grain feed means for feeding a continuous mass of grain into said concentric chamber of said second housing section to be picked up by said screw conveyor means, abrasive rotor means mounted on said hollow axle next to said screw conveyor means and within said third housing section, said rotor means comprising a plurality of abrasive discs mounted on said hollow axle and spaced from each other by means of alternate spacer rings also mounted on said hollow axle between said abrasive discs, said spacer rings being of a diameter smaller than that of the abrasive discs to provide expansion chambers for the mass of grain between each pair of abrasive discs, said spacer rings and said hollow axle being provided with matching radial bores to permit the passage of air through said expansion chambers for entraining the dust, flour and bran released by the abrading action of said discs while the mass of grains is under a reduced compacting pressure in view of the expansion suffered thereby within said expansion chambers, screen means comprising a plurality of screen sections spaced by means of a corresponding plurality of alternated abrading sections, said screen means being mounted within said third housing section in confronted relationship with said rotor means, in order to co-act therewith for abrading and rubbing the mass of grains, grain outlet means on the cylindrical wall of said fourth housing section, said outlet means being plugged by a weighted lid, particle laden air outlet means constituted by the annular spaces formed between the outer walls of said third and second housing sections, and said screen means in said third housing section and said concentric chamber in said second section, and particle laden air exhaust chute means arranged within said first housing section and adapted to be connected to air suction means.

10. A machine as claimed in claim 9 wherein each one of said abrading discs comprises a cam-like flat cylindrical body provided with a central circular opening of a diameter suitable for mounting of said disc on said hollow axle of the machine, and an outer periphery which is a circumferential surface modified in two identical diametrically opposed sections thereof, by providing a first circumferentially section of a predetermined diameter, followed by a curved outwardly ascending section for communicating said first circumferential section with a circumferential lobe having a diameter larger than said first circumferential section, said larger diameter circumferential lobe being continued with a radially inwardly directed surface which forms a shoulder on the cam surface of the disc and, from the inner end of said shoulder, the cam surface being completed by means of a relatively flat section the other end of which is joined with a second circumferential section which is identical with said first circumferential section and diametrically opposed thereto, with the remaining of the periphery of the disc being identical with the first half thereof.

11. A machine as claimed in claim 10 wherein said discs are made of an abrasive material.

12. A machine as claimed in claim 10 wherein said discs are made of a non-abrasive material having a harsh surface.

13. A machine as claimed in claim 10 wherein said spacer rings are separate rings mounted on said axle.

14. A machine as claimed in claim 10 wherein said spacer rings are integral with said axle.

15. A machine as claimed in claim 9 wherein said screen means comprises screen holder means, a plurality of vertical abrasive elongated blocks arranged along the circumference of said screen holder means, and a corresponding plurality of vertical screen sections alternately arranged between said abrasive blocks.

16. A machine as claimed in claim 9 wherein said screen means comprises screen holder means, a plurality of abrasive rings mounted horizontally along the length of said screen holder means, and a corresponding plurality of cylindrical screen sections alternately arranged between said abrasive rings.

17. An air-swept grain husking and/or polishing machine which comprises an approximately cylindrical housing longitudinally divided into first, second, third and fourth intercommunicated longitudinal sections, a hollow axle arranged concentrically within said housing and rotatively mounted on bearing means mounted within an isolated chamber concentrically arranged within said first housing section, said hollow axle extending throughout the length of said first, second and third housing sections, rotational driving means attached to the end of said hollow axle outwardly of said isolated chamber, air inlet means connected to the driven end of said hollow axle for permitting a stream of air to be drawn into the hollow space of said hollow axle, grain pressurizing screw conveyor means mounted on said axle within a concentric chamber arranged in said second housing section, grain feed means for feeding a continuous mass of grain into said concentric chamber of said second housing section to be picked up by said screw conveyor means, abrasive rotor means mounted on said hollow axle next to said screw conveyor means and within said third housing section, screen means mounted on means for adjusting the eccentricity thereof with respect to said hollow axle and to said rotor means, said screen means comprising a plurality of screen sections spaced by means of a corresponding plurality of alternated abrading sections, said screen means being mounted within said third housing section in confronted relationship with said rotor means, said eccentricity adjusting means comprising an annular plate having a pair of diametrically opposed arms, the free end of one of said arms being pivotally mounted on said housing and the opposite arm thereof being engaged by a plate sidewardly displacing mechanism for moving said arm towards any one of two sideward opposite directions, whereby said screen means mounted on said plate will be moved sidewardly to adjust the eccentricity thereof with respect to said axle and rotor means in order to vary the strength of the abrading action exerted on the grain by said abrasive rotor and said screen means, said rotor means comprising a plurality of abrasive discs mounted on said hollow axle and spaced from each other by means of alternate spacer rings also mounted on said hollow axle between said abrasive discs, said spacer rings being of a diameter smaller than that of the abrasive discs to provide expansion chambers for the mass of grain between each pair of abrasive discs, said spacer rings and said hollow axle being provided with matching radial bores to permit the passage of air through said expansion chambers for entraining the dust, flour and bran released by the abrading action of said discs while the mass of grains is under a reduced compacting pressure in view of the expansion suffered thereby within said expansion chambers, grain outlet means on the cylindrical wall of said fourth housing section, said outlet means being plugged by a weighted lid, particle laden air outlet means constituted by the annular spaces formed between the outer walls of said third and second housing sections, and said screen means in said third housing section and said concentric chamber in said second section, and particle laden air exhaust chute means arranged within said first housing section and adapted to be connected to air suction means.

* * * * *